US006328421B1

(12) United States Patent
Kojima et al.

(10) Patent No.: US 6,328,421 B1
(45) **Date of Patent: *Dec. 11, 2001**

(54) FLUID DROP PROJECTING HEAD USING TAPER-SHAPED CHAMBER FOR GENERATING A CONVERGING SURFACE WAVE

(75) Inventors: Ryuichi Kojima; Yasuhiro Otsuka; Fuminori Takizawa, all of Tokyo (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/699,946

(22) Filed: Aug. 20, 1996

(30) Foreign Application Priority Data

Aug. 22, 1995 (JP) ..... 7-213442

(51) Int. Cl.[7] ..... B41J 2/135

(52) U.S. Cl. ..... 347/46; 347/88; 347/61; 347/56

(58) Field of Search ..... 347/46, 47, 88, 347/61

(56) References Cited

U.S. PATENT DOCUMENTS

| | | | | |
|---|---|---|---|---|
| 3,211,088 | * | 10/1965 | Naiman | 347/46 |
| 3,946,398 | | 3/1976 | Kyser et al. | 347/70 |
| 4,380,018 | * | 4/1983 | Andoh et al. | 347/46 |
| 4,734,706 | | 3/1988 | Le et al. . | |
| 5,194,880 | | 3/1993 | Elrod et al. | 347/46 |
| 5,216,451 | * | 6/1993 | Rawson et al. | 347/46 |
| 5,277,754 | | 1/1994 | Hadimioglu et al. | 156/644 |
| 5,305,016 | * | 4/1994 | Quate | 347/46 |
| 5,406,318 | | 4/1995 | Moore et al. . | |
| 5,415,679 | | 5/1995 | Wallace | 347/46 |
| 5,495,270 | | 2/1996 | Burr et al. . | |
| 5,591,490 | | 1/1997 | Quate | 427/457 |
| 5,821,958 | * | 10/1998 | Lim | 347/46 |

FOREIGN PATENT DOCUMENTS

| | | | |
|---|---|---|---|
| 0243118 | | 10/1987 | (EP) . |
| 0418659 | | 3/1991 | (EP) . |
| 0513441 | | 11/1992 | (EP) . |
| 549244A1 | * | 6/1993 | (EP) ..... 347/46 |
| 2220618 | | 1/1990 | (GB) . |
| 57176172 | | 10/1982 | (JP) . |
| 6159911 | | 12/1986 | (JP) . |

(List continued on next page.)

OTHER PUBLICATIONS

Patent Abstracts of Japan. JP–58–A–162675 (Ricoh K.K) Sep. 1983.*
English Abstract for JPA 57–176172.
English Abstract for JPA 4–148938.

*Primary Examiner*—Benjamin R. Fuller
*Assistant Examiner*—C. Dickens
(74) *Attorney, Agent, or Firm*—Sughrue, Mion, Zinn, Macpeak & Seas, PLLC

(57) ABSTRACT

A fluid drop projecting apparatus which can fly, one by one, fluid drops far smaller than the opening bore from which the drops are projected, and moreover cay readily vary the size of the fluid drops, is provided. To this end, surface waves travelling toward a fluid drop projecting point are applied on the free surface of fluid in a fluid drop projecting chamber having an opening. The surface waves are generated by a surface wave generator including the fluid drop projecting chamber, a diaphragm and a piezo actuator. As the surface waves are generated by the surface wave generator at substantially equal distances from a fluid drop projecting point, the height of the surface waves gradually increases, amplified by their interference, and fluid drops are separated at and projected from the fluid drop projecting point.

16 Claims, 11 Drawing Sheets

FOREIGN PATENT DOCUMENTS

| | | | | |
|---|---|---|---|---|
| 63005949 | | 1/1988 | (JP) | B41J/3/04 |
| 63162253 | | 7/1988 | (JP) . | |
| 414455 | | 1/1992 | (JP) . | |
| 4-33862 | * | 2/1992 | (JP) | 347/46 |
| 4148938 | | 5/1992 | (JP) . | |
| 4299148 | | 10/1992 | (JP) . | |
| 538810 | | 2/1993 | (JP) . | |
| 7 8562 | | 2/1995 | (JP) . | |

* cited by examiner

FLUID DROP PROJECTING HEAD USING TAPER-SHAPED CHAMBER FOR GENERATING A CONVERGING SURFACE WAVE

BACKGROUND OF THE INVENTION

The present invention relates to an apparatus for projecting fluid drops, and more particularly to an ink jet recording head for causing minute fluid drops to fly to a recording medium to record visual images. The invention relates to an apparatus for projecting fluid drops, and more particularly to an apparatus for causing electroconductive materials, which are solid at normal temperature and melted by heating, in a state of fluid drops to a circuit substrate or the like and forming bumps thereon for connection to LSIs or the like.

DESCRIPTION OF THE PRIOR ART

Fluid drop projecting apparatuses according to the prior art for use in ink jet printers among others include one disclosed in the U.S. Pat. No. 3,946,398 in which, as illustrated in FIG. 13A, a piezo element 12 is oscillated to expand the volume of an ink chamber 30 thereby to suck a fluid 14, such as ink, from an ink tank (not shown) and, afterwards, as illustrated in FIG. 13B, the volume of the ink chamber 30 is compressed to apply pressure to the fluid 14 thereby to cause fluid drops 20 to fly from a nozzle 31 onto a recording medium. They also include another described in the Japanese Patent Publication No. 61(1986)-59911 in which a heating element is built into an ink chamber, bubbles are instantaneously generated by thermal energy in ink, and the ink is projected by the expansive force of the bubbles. According to the prior art, many fluid drop projecting apparatuses utilizing the principle of pumping have been proposed.

Known fluid drop projecting apparatuses which fly a mist of ink include ones disclosed in the Gazettes of the Japanese Patents Laid-open No. 4(1992)-14455, 4(1992)-299148 and 5(1993)-38810. The one according to the Patent Laid-open No. 4(1992)-14455, illustrated in FIGS. 14A and 14B, uses as a driver a propagation plate 32 at one end of whose propagation face 33 a plurality of pairs of comb-shaped electrodes IDT 34 are formed; a high-frequency A.C. voltage 35 of about 20 MHz is applied to the driver to excite the surface of the propagation face 33 and thereby to generate a surface elastic wave A. The surface elastic wave A thereby generated travels in the direction of the arrow in the diagram and, when it reaches a part where the propagation face 33 is in contact with ink 14, leaks therefrom to the ink 14 to become a longitudinal elastic wave (acoustic wave), which excites a surface 37 of the ink exposed in a slit 36 to fly a mist of fluid drops 20.

In the apparatus described in the Patent Laid-open No. 4(1992)-299148, as shown in FIG. 15, a gap is formed between a slit member 38 and a resonator 39 to compose an ink chamber 30. The ink chamber 30 is filled with ink 14 by capillary action; resonant vibration is applied to the resonator 39 in the thickness direction; the energy of vibration is propagated to the ink eventually to form a random surface wave on an ink interface 41 at an ink outlet 40, so that the interference of the surface wave causes particles of ink to be projected in a mist form according to the vibrating frequency of the resonator.

According to the Patent Laid-open No. 1993-38810, as illustrated in FIG. 16, a pair of electrodes 43 are formed on the upper and lower faces of a piezoelectric substrate 42, to which a nozzle plate 45 is joined via a gap supporter 44, and the gap is filled with ink 14 by capillary force. When a voltage displaced by a resonant frequency, which is determined by the thickness of the piezoelectric substrate 42, is applied to an intersection area 46 formed by the electrodes 43, the piezoelectric substrate 42 resonates to generate an ultrasonic wave in the ink 14. The ultrasonic wave travels through the ink 14 to generate a surface wave on a surface 37 of ink filling a nozzle 31 immediately above the intersection area 46. When the amplitude of this surface wave surpasses a certain level, ink drops 20 are projected in a mist form from the nozzle 31.

According to any one of the above-cited Patents Laid-open Nos. 1992-14455, 1992-299148 and 1993-38810, though differing in means to generate a surface wave on the ink surface, a surface wave is generated at random on the free surface of fluid by the same principle as that of mist projection by ultrasonic humidifiers, and the interference of the surface wave causes the fluid to be projected in a mist form from an indefinite large number of projection points.

A fluid drop projecting apparatus utilizing the sound pressure of acoustic streaming is disclosed in the Gazette of the Japanese Patent Laid-open No. 63(1988)-162253. According to the invention described in this patent, as shown in FIG. 17, an ultrasonic acoustic wave is generated by the vibration of a piezoelectric transducer 47 and converged by a spherical acoustic lens 48 on one point on the free surface 15 of fluid 14, so that radiation pressure generated when the acoustic wave hits the free surface 15 of the fluid 14 works to separate fluid drops 20 from the free surface of the fluid and project them.

Ink jet and various other types of printers are increasingly required to be capable of providing pictorial color image outputs. Meeting this requirement needs a recording characteristic of continuous and smooth shade gradation from the high light to the shadow. In order to achieve such a gradation recording characteristic by an ink jet method, it is necessary either to modulate the gradation by varying the volume of an ink drop from pixel to pixel or to compose each pixel of a plurality of ink drops each of which is smaller than a pixel and to vary the number of ink drops. By either method, in order to realize smooth shading gradation with no tone jump, a technique to form fluid drops sufficiently smaller than pixels is indispensable. However, with any of the above-described fluid drop projecting apparatuses, it is difficult to form so fine fluid drops for the following reasons.

With the fluid drop projecting apparatuses described in the U.S. Pat. No. 3,946,398 and the Gazette of the Japanese Patent Publication No. 1986-59911, illustrated in FIGS. 13A, 13B, the minimum diameter of fluid drops that can be projected is about equal to the nozzle bore because both project fluid drops by utilizing the principle of pumping, and it is extremely difficult to project fluid drops having a diameter equal to, say, 1/10 of the nozzle bore. Therefore, in order to enable any such fluid drop projecting apparatus to project very fine fluid drops, the nozzle bore should be reduced to about the desired diameter of fluid drops. However, such a small nozzle bore would make the nozzle more susceptible to choking and accordingly less reliable. Therefore, it is extremely difficult to form fluid drops as fine as a few $\mu$m to 20 $\mu$m in diameter. Moreover, the smaller nozzle bore means the need for more precise machining with the consequence that, where minute fluid drops have to be projected from an apparatus based on the principle of pumping, a problem arises not only with reliability but also with productivity.

Next, the fluid drop projecting apparatuses described in the Gazettes of the Japanese Patents Laid-open Nos. 1992-

14455, 1992-299148 and 1993-38810, which generate a surface wave on the free surface of fluid and project fluid drops in a mist form, can project a mist of fluid drops as fine as a few $\mu$m in diameter. They further can control the number of fluid drops reaching the recording medium by varying the duration of projection. However, with these fluid drop projecting apparatuses, as a result of using the interference of the surface wave generated at random on the free surface of fluid, fluid drops are projected in a mist form from an indefinite large number of projection points, inviting fluctuations in the diameter of fluid drops projected, and moreover the direction and speed of projection also vary from drop to drop. This entails a problem in drop-by-drop controllability, which has to be precise for ink jet recording heads or bump forming devices. In other words, it is difficult to precisely control the positions and volumes of fluid drops reaching at the recording medium.

The utilizing fluid drop projecting apparatus disclosed in the Gazette of the Japanese Patent Laid-open No. 1988-162253, which utilizes a sound wave, requires large ultrasonic oscillators because of its inefficient utilization of the energy of vibration, and accordingly entails a correspondingly large overall hardware size. Moreover, as the focal depth of the acoustic lens is very shallow, means for precisely controlling the position of the free surface of ink is required, and as each individual ultrasonic oscillator needs an acoustic lens, the hardware configuration is inevitably complex. Furthermore, the apparatus cost is high because the circuit configuration requires a band to pass signals of hundreds of MHz, involving a high-frequency power amplifying and generating section for generating and amplifying high-frequency signals of several MHz to hundreds of MHz and a high-frequency power switching section.

SUMMARY OF THE INVENTION

An object of the present invention is to solve these problems of the prior art and to provide a fluid drop projecting apparatus which can fly one by one fluid drops far smaller than the opening from which the drops are projected to the desired arrival position of each, and moreover can be realized in a simple and inexpensive configuration. Another object of the invention is to provide a fluid drop projecting apparatus capable of readily varying the drop size.

According to the invention, there is provided a fluid drop projecting apparatus comprising at least a fluid drop projecting chamber having an opening involving a fluid drop projecting point, and a surface wave generator for forming on the free surface of fluid filling said fluid drop projecting chamber, the free surface being formed at the opening of said fluid drop projecting chamber, surface waves at substantially equal distances from said fluid drop projecting point and travelling toward said fluid drop projecting point.

In the fluid drop projecting apparatus according to the invention, said surface waves may have a circular shape centering on said fluid drop projecting point.

In the fluid drop projecting apparatus according to the invention, said surface wave generator may have a waveform controller capable of controlling the height and length of the surface waves as desired.

In the fluid drop projecting apparatus according to the invention, said surface wave generator comprises at least a fluid drop projecting chamber having a circular or polygonal opening whose bore gradually expands from the surface in the direction of depth and a fluid stream generator for flowing that part of said fluid which is near the bottom of said fluid drop projecting chamber in an intermittent stream from the bottom of said fluid drop projecting chamber toward the surface, and is configured so as to enable the action of said fluid stream to prevent fluid drops from being projected from the free surface of said fluid.

In the fluid drop projecting apparatus according to the invention, said fluid stream generator is provided with a fluid stream controller capable of controlling as desired the speed and duration of said fluid stream.

In the fluid drop projecting apparatus according to the invention, said fluid stream generator comprises a diaphragm which is connected to the bottom of said fluid drop projecting chamber and can be displaced in the direction from the bottom of said fluid drop projecting chamber toward the surface and an actuator connected to said diaphragm.

In the fluid drop projecting apparatus according to the invention, said fluid stream generator is configured by arranging a heating element near the bottom of said fluid drop projecting chamber.

In the fluid drop projecting apparatus according to the invention, said heating element is arranged on the periphery of the bottom of said fluid drop projecting chamber.

In the fluid drop projecting apparatus according to the invention, said fluid is a hot melt medium which is solid at normal temperature and melted by heating, said apparatus being provided with means to heat said hot melt medium.

In the fluid drop projecting apparatus according to the invention, said hot melt medium is electroconductive.

By the fluid drop projecting method according to the invention, surface waves travelling toward a fluid drop projecting point are formed on the free surface of fluid at substantially equal distances from said fluid drop projecting point.

BRIEF DESCRIPTION OF THE DRAWINGS

The above-mentioned and other objects, features and advantages of the present invention will become more apparent from the following detailed description when taken in conjunction with the accompanying drawings, wherein:

FIG. 1A and FIG. 1B respectively show an overall plan of an ink jet recording head comprising a plurality of fluid drop projecting apparatuses and a cross section of a fluid drop projecting apparatus;

FIG. 3A, FIG. 3B and FIG. 3C respectively show a cross section of the fluid drop projector in a state where surface waves are generated, a cross section of the fluid drop projector in a state where a fluid pillar is generated by the travel of the surface waves, and a cross section of the fluid drop projector in a state where fluid drops are flying;

FIG. 4A and FIG. 4B respectively show a perspective view of the recording apparatus and a front view of the recording head;

FIG. 5A shows a cross section of the fluid drop projecting apparatus in a state where fluid drops are projected in a mist form by the direct action of the fluid stream, and FIG. 5B, a cross section of the fluid drop projecting apparatus in a state where fluid drops about equal in size to the bore of the opening are projected by the direct action of the fluid stream;

FIG. 6A and FIG. 6B respectively illustrate fluid drop projecting apparatuses having dodecagonal openings and another having hexagonal openings;

FIG. 11A and FIG. 11B respectively show a cross section of a fluid drop projecting apparatus whose fluid drop projecting chamber has an opening expanding in a bell mouth shape in the direction of depth and another whose fluid drop projecting chamber has an opening expanding step-wise in the direction of depth;

FIG. 14A and FIG. 14B respectively show a perspective view and a cross section;

DETAILED DESCRIPTION OF THE EMBODIMENTS

Figure 3A:
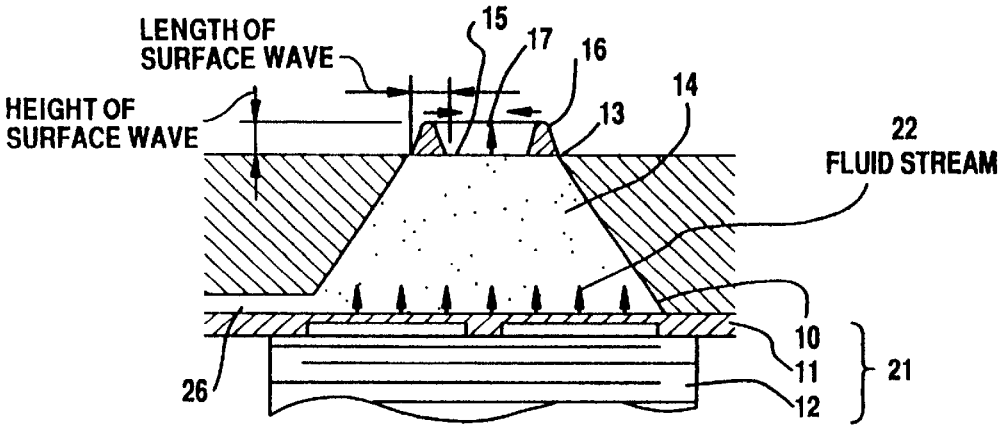
FIGS. 3A, 3B and 3C illustrate the projecting process of fluid drops in Embodiment 1 of the invention.
Figure 3B:
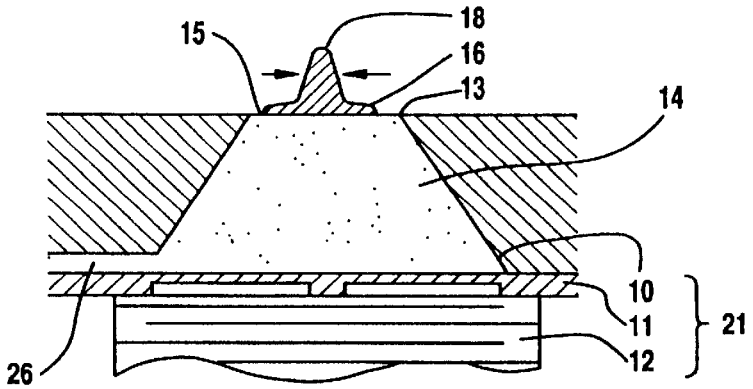
Figure 3C:
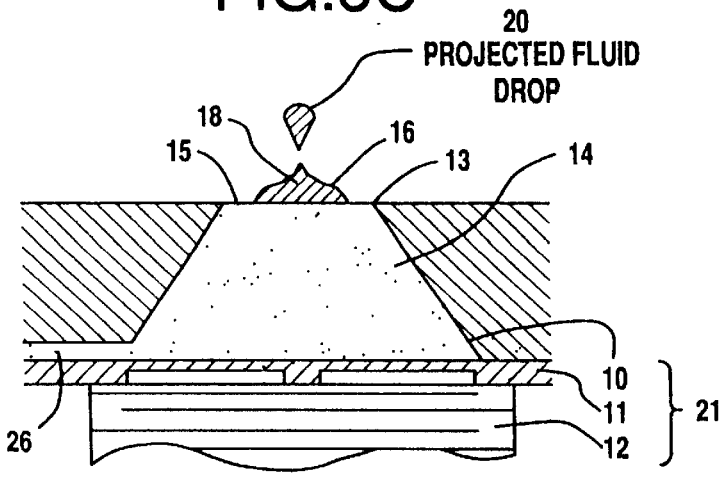

With reference to FIGS. 3A, 3B and 3C, how the present invention works will be described below. These figures comprise cross sectional views of a fluid drop projecting apparatus illustrating the process of fluid drop projection; FIGS. 3A, 3B and 3C respectively show a state in which surface waves are generated, a state in which a fluid pillar is generated by the travel of the surface waves, and a state in which fluid drops are flying. In the drawings, reference numeral 10 denotes a fluid drop projecting chamber; 11, a diaphragm; 12, a piezo actuator; 21, a surface wave generator; and 13, an opening.

The fluid drop projecting apparatus according to the invention, as shown in FIGS. 3, has the fluid drop projecting chamber 10, which has the opening 13, and the surface wave generator 21 for generating surface waves 16, which travel toward a fluid drop projecting point 17 over a free surface 15 of fluid filling the fluid drop projecting chamber 10.

As shown in FIG. 3A, the surface wave generator 21 generates the surface waves 16 at substantially equal distances from the fluid drop projecting point 17. Thus, the surface waves 16 are generated on either the whole or part of the periphery of a circle or a polygon around the fluid drop projecting point 17. As these surface waves 16 travel toward the fluid drop projecting point 7, the surface waves which are in phase interfere with one another, and the surface waves 16 gradually increase in height. As a result, a fluid pillar 18 is formed in the vicinity of the fluid drop projecting point 17 as shown in FIG. 3B. The wave height reaches its maximum at the fluid drop projecting point 17, and eventually a fluid drop is separated and projected from the top of the fluid pillar 18 as illustrated in FIG. 3C.

The diameter of the projected fluid drop 20, as is evident from FIGS. 3B and 3C, varies in proportion to the thickness (diameter) of the fluid pillar 18 immediately before the projection. The diameter of the fluid pillar 18 in turn varies substantially in proportion to the wave-length of the surface waves 16. Here, the wavelength of the surface waves is defined by $\lambda$ shown in FIG. 3A. Whether or not the fluid drop 20 is projected depends on the height of the fluid pillar 18, i.e. the height of the surface waves 16. Therefore, it is seen that, according to the present invention, the diameter of fluid drops does not depend on the size of the opening but can be varied with the wavelength of the surface waves 16. Furthermore, whether or not a fluid drop is projected can be controlled by varying the height of the surface waves 16.

Such surface waves can be formed by bringing into action an intermittent fluid stream 22 from the bottom of the fluid drop projecting chamber 10, whose opening gradually expands from the surface toward the bottom as illustrated in FIG. 3A, toward the surface. The fluid stream 22, which flows from the bottom of the fluid drop projecting chamber 10 toward the surface, is subjected to increasing pressure near the wall face of the fluid drop projecting chamber 10, as its opening bore narrows toward the surface, and increases in speed near the wall face, resulting in the generation of surface waves 16, conforming to the shape of the opening 13, on the free fluid surface 15. Therefore, if a circular opening is used, circular surface waves can be formed or, alternatively, if a polygonal opening is used, polygonal surface waves can be formed. It has been confirmed by experiment that, here, the wavelength $\lambda$ of the surface waves 16 that are formed can be controlled as desired mainly by varying the duration of the generation of the fluid stream 22, and the wave height of the surface waves 16 that are formed can be controlled as desired mainly by varying the speed of the fluid stream 22. The term "fluid stream" as used in describing the present invention is defined as collectively denoting both the non-compressive stream of fluid and the acoustic stream due to the compression of fluid.

When formed in a circular shape, the surface waves 16 register the highest height amplification rate owing to their interference and, as the surface waves which are completely in phase travel toward the fluid drop projecting point while interfering with one another, can achieve the most efficient, steady and reliable projection of fluid drops.

Next will be described in detail preferred embodiments of the present invention.

Embodiment 1

Figure 1A:
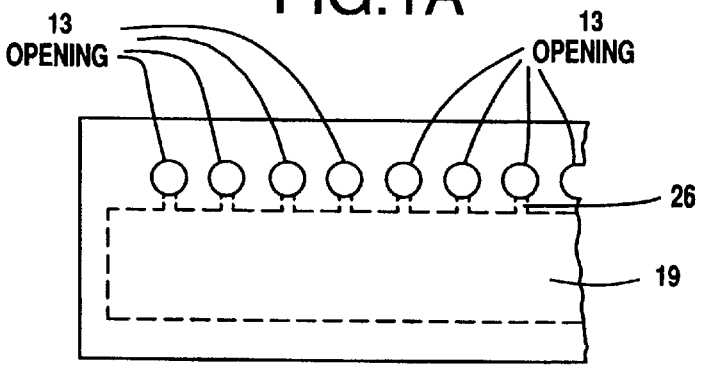
FIGS. 1A and 1B illustrate fluid drop projecting apparatuses which are first and fourth embodiment (Embodiments 1 and 4) of the invention.
Figure 1B:
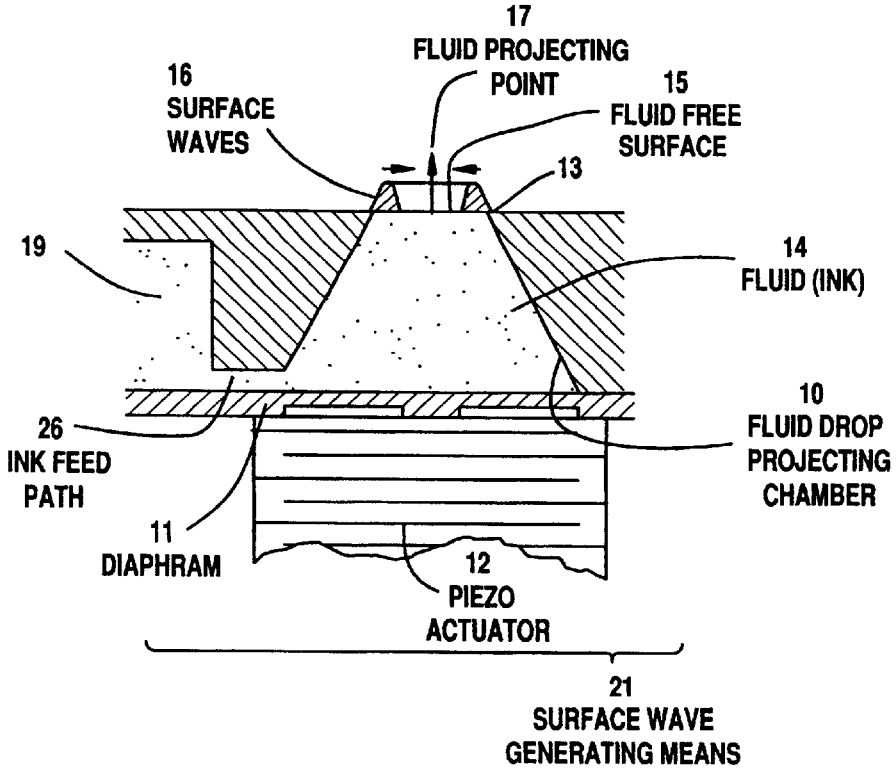

FIGS. 1A and 1B respectively show a plan and a cross section of fluid drop projecting apparatuses, which constitute a first preferred embodiment of the invention. As illustrated in FIG. 1A, Embodiment 1 comprises a plurality of fluid drop projecting apparatuses arranged in parallel for application to an ink jet recording head. Each individual fluid drop projecting apparatus, as illustrated in FIG. 1B, comprises a fluid drop projecting chamber 10 whose opening bore gradually expands in the direction of depth, a diaphragm 11 connected to the bottom of the fluid drop projecting chamber 10, and a pizeo actuator 12 connected to the diaphragm 11. The fluid drop projecting chamber 10 is filled with fluid ink 14, and is in continuity to an ink tank 19 via an ink feed path 26. Here, an opening 13 and the bottom of the fluid drop projecting chamber 10 are circularly shaped, respectively measuring 80 μm and 240 μm in diameter, and the fluid drop projecting chamber 10 is 100 μm deep. The center-to-center pitch between immediately adjoining openings is 254 μm.

Figure 2:
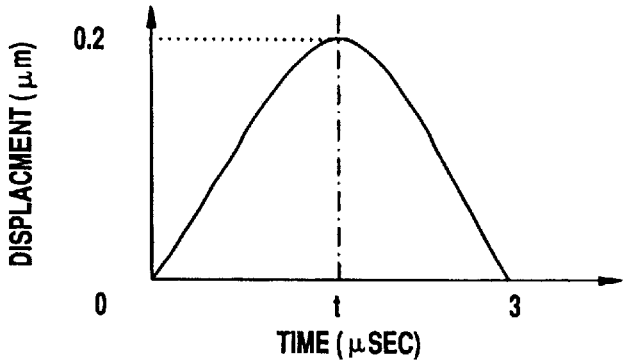
FIG. 2 illustrates the drive waveform of the piezo actuator in Embodiment 1 of the invention.

First, the fluid projecting performance of the fluid projecting apparatus was checked. It was confirmed that, when the piezo actuator 12 was given a displacement of a single triangular wave-shaped time response of 3 μs in time width and 0.2 μm in displacement width as shown in FIG. 2, ink drops of about 15 μm could be steadily projected from the center of the opening 13. How these fluid drops 20 were projected was observed stroboscopically. When the pizeo actuator 12 was driven so as to displace the diaphragm 11, first the formation process of circular surface waves 16, such as shown in FIG. 3A, was witnessed. These circular surface waves 16, as they travel toward the center, i.e. toward a fluid projecting point 17, were gradually amplified in height, and formed a fluid pillar 18, such as shown in FIG. 3B, in the vicinity of the fluid projecting point 17. Immediately after that, as illustrated in FIG. 3C, an ink drop 20 of about 15 μm in diameter was separated from the fluid pillar 18, and flew upward. Thus it was confirmed that the fluid drop projecting apparatus according to the invention, as it projects fluid drops by utilizing the interference of surface waves, can project ink drops 20 far smaller than the bore of the opening 13. Although the drive waveform for the piezo actuator 12 in this particular embodiment is triangular as shown in FIG. 2, it was further confirmed that, if only surface waves 16 such as shown in FIG. 3A could be formed on the free surface 15 of fluid, any waveform, such as a sine wave, a rectangular wave or a combination thereof, could be used to project fluid drops of a diameter smaller than the bore of the opening 13 as in Embodiment 1.

Figure 4A:
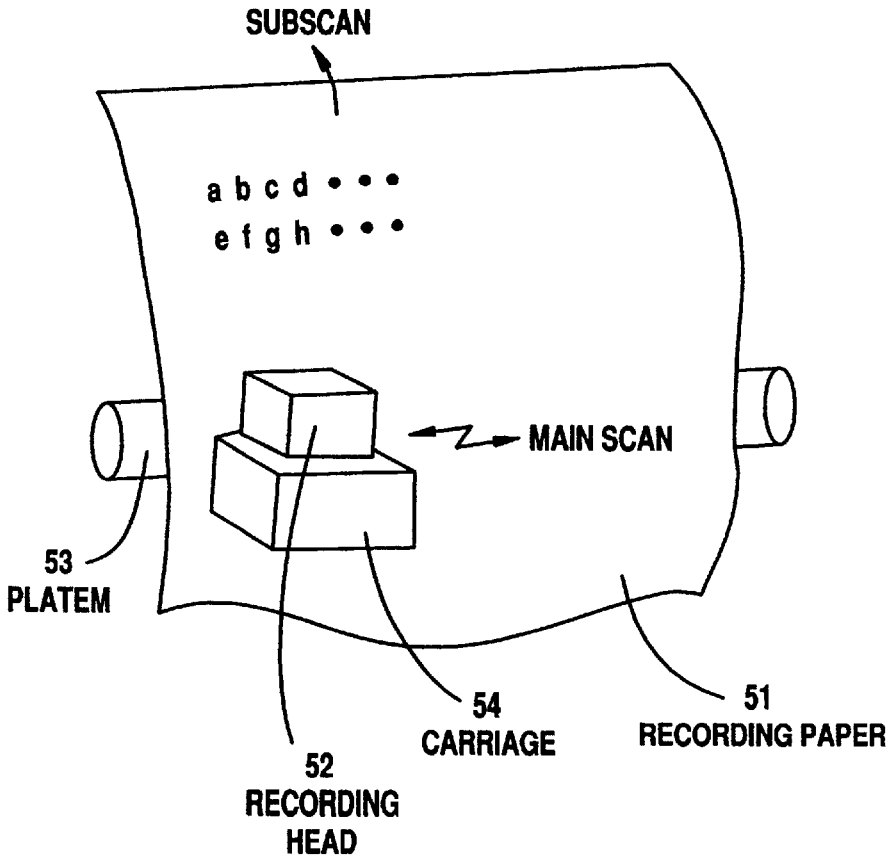
FIGS. 4A and 4B illustrate the configuration of an ink jet recording apparatus mounted with a fluid drop projecting apparatus according to the invention.
Figure 4B:
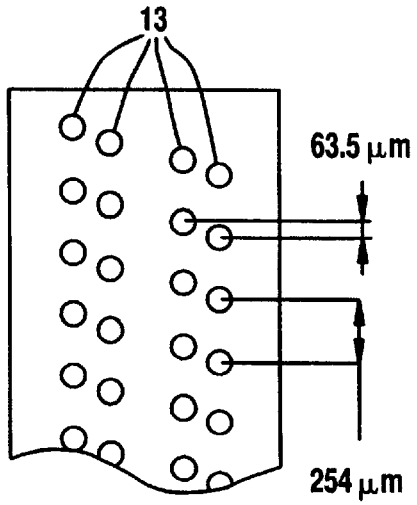
Figure 5A:
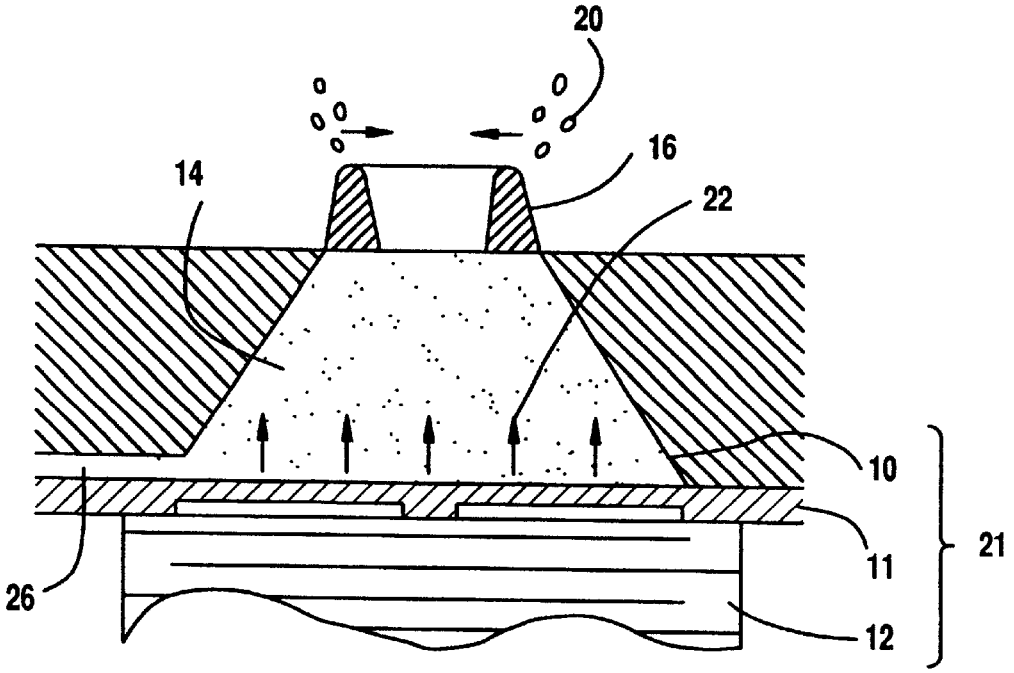
FIGS. 5A and 5B compare different states in Embodiment 1 of the invention.
Figure 5B:
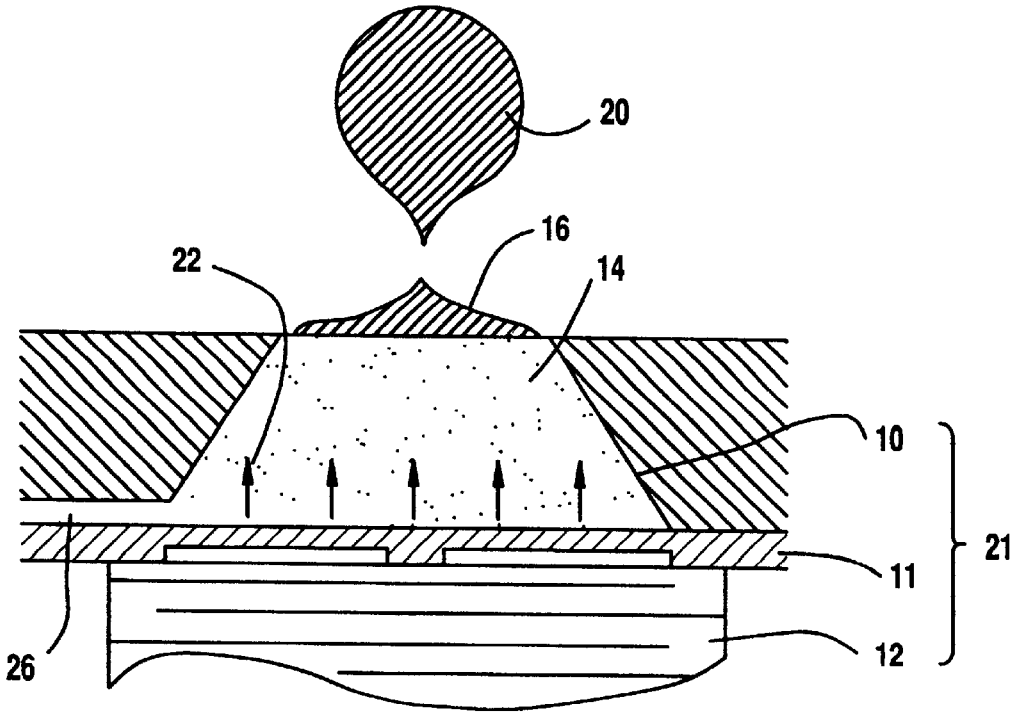

Then, an ink jet recording head was composed of such fluid drop projecting apparatuses, and a printing experiment was carried out with it. FIG. 4A shows an external perspective view of the printer, and FIG. 4B shows a plan of openings 13 in the face opposite to the recording paper of the recording head. In the diagram, reference numeral 51 denotes the recording paper; 52, the recording head; and 53, a platen. The recording head 52, having a plurality of openings 13, was fixed to a carriage 54 so that these openings 13, from which ink would be projected, were opposite to the platen 53 with the recording paper 51 in-between. Four rows of 32 openings 13 each, serving as ink projecting points, were arranged in a zigzag form as illustrated in FIG. 4B, so that the recording head 52 comprised altogether 128 openings 13 arranged at 63.5 μm pitches. Incidentally, individual fluid drop projecting apparatuses were enabled to be controlled independently of one another by electric recording signals as to whether or not to project ink.

Printing was accomplished in the following manner. First, as illustrated in FIG. 4A, the recording head 52 was caused to scan the platen 53 by the carriage 54 (main scanning). By controlling the timing of fluid drop flying with the 128 fluid drop projecting apparatuses at 15.875 μm pitches in the main scanning direction in accordance with image signals, four rows of pixels were formed at a pixel density of 1600 dpi in the main scanning direction and at 400 dpi in the subscanning direction. Then, after advancing the recording paper 51 by 15.875 μm in the subscanning direction as shown in FIG. 4A, the recording head 52 was caused to perform main scanning in the direction reverse to the first scanning, and another four rows of pixels were formed in the same way as in the first scanning. By performing altogether four rounds of such scanning, 16 rows of pixels were formed at a pixel density of 1600 dpi in both main scanning and subscanning directions. Next, after moving the recording paper by 206.375 μm in the subscanning direction, 16 rows were printed in the same way as described above. By repeating the moving of the recording paper 51 by 206.375 μm in the subscanning direction after every 16 rows of printing, an image was formed on an A4 size piece of the recording paper 51 at a resolution of 1600 dpi in both main scanning and subscanning directions.

Incidentally, when the dot diameters of the ink drops projected from the fluid drop projecting apparatuses on the recording paper 51 were measured, they were found to be about 21 μm, the right size not to let any undesired blank left even when characters were printed closely. Thus, the fluid drop projecting apparatuses according to the present invention, in spite of the 400 dpi intervals between their openings 13, was confirmed to be able to form images of as high a resolution as 1600 dpi because they can project fluid drops far smaller than their opening bore.

In the embodiment described above, the drive conditions for the piezo actuator 12 were adjusted not to let fluid drops 20 be projected from the free surface 15 of the fluid by the direct action of the fluid stream 22. In the embodiments to be described below, for the sake of comparison, projection of fluid drops 20 by the direct action of the fluid stream 22 was attempted. When the displacement of the piezo actuator 12 was gradually increased from 0.2 μm eventually to 0.35 μm, a plurality of minute fluid drops 20 were projected at random from the leading edges of the surface waves 16 simultaneously with the formation of the surface waves 16. In this stated, as both diameters and flying directions of the fluid drops 20 were random, it was impossible to control the arriving position of each of the fluid drops 20. Then, when the displacement of the piezo actuator 12 was further increased to 0.5 μm, large fluid drops 20, about equal to the bore of the opening 13, were projected by the conventional mechanism utilizing the principle of pumping. Thus it was confirmed that, in order to fly fluid drops 20 smaller than the opening 13 while controlling the arriving position of each, the fluid stream 22 had to be generated so as not to let any fluid drop 20 be flown from the free fluid surface 15 by the direct action of the fluid stream 22.

Embodiments 2 and 3

Figure 6A:
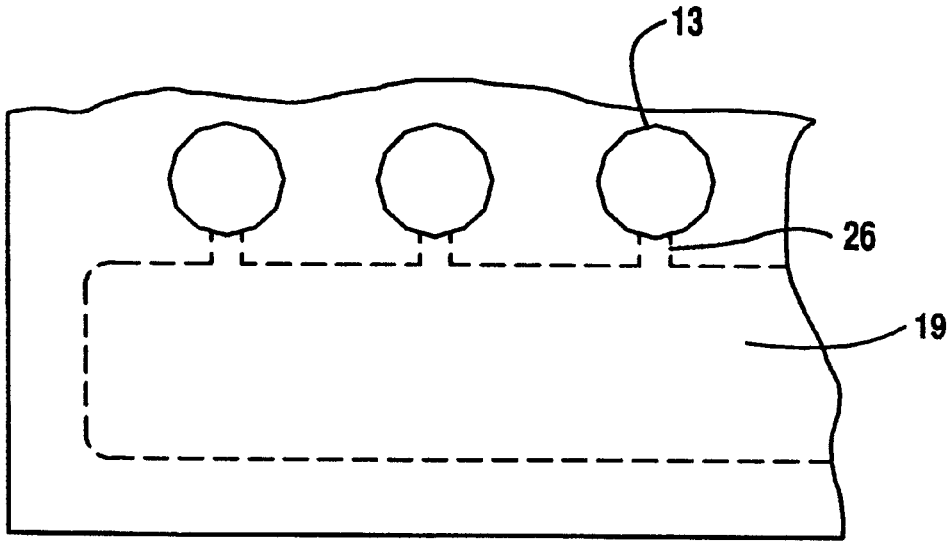
FIGS. 6A and 6B show plans of second and third embodiments (Embodiments 2 and 3) of the invention.
Figure 6B:
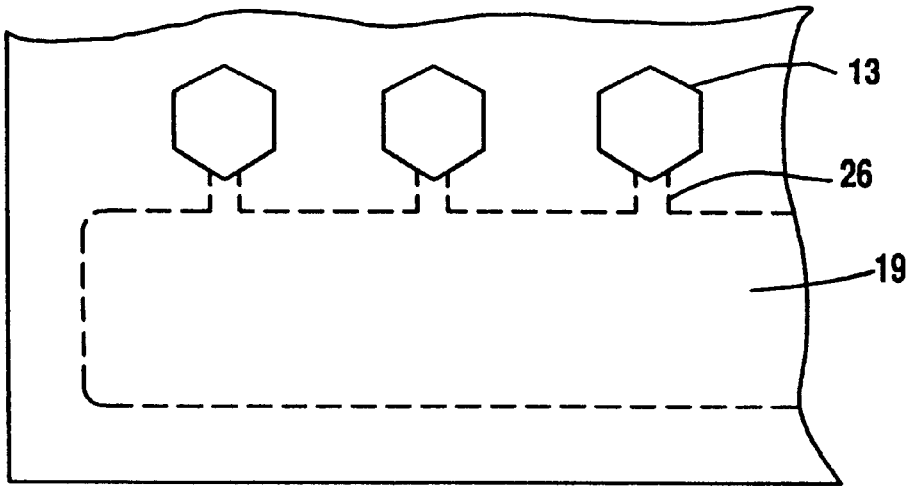

FIGS. 6A and 6B show plans of fluid projecting apparatuses which constitute respectively second and third preferred embodiments of the present invention. FIG. 6A shows a plan of fluid drop projecting apparatuses each having an opening 13 of a regular dodecagon circumscribing a circle of 80 μm in diameter, and FIG. 6B, a plan of fluid drop projecting apparatuses each having an opening 13 of a regular hexagon circumscribing a circle of 80 μm in diameter. Other aspects than the shape of the opening 13 of these embodiments were the same as those of the fluid drop projecting apparatus illustrated in FIG. 1B. Under the same driving conditions for the piezo actuator 12 as for that of Embodiment 1, no fluid drop was projected by either of the apparatuses shown in FIGS. 6A and 6B. This state was observed stroboscopically in the same manner as for Embodiment 1. As in Embodiment 1, it was witnessed that the driving of the actuator resulted in the formation of surface waves in conformity with the shape of the polygonal openings, and the height of these surface waves gradually increased as they approached the center eventually to form fluid pillars. However, it was found that no fluid drop was projected because of the lower height amplification rate of the surface waves, and that the rate was higher for the dodecagonal openings, which were closer to circles. In view of this finding, the displacement of the piezo actuator 12 was increased to attempt fluid drop projection, and the projection of fluid drops 20 became possible at a displacement of 0.24 μm for the apparatus of FIG. 6A and at 0.28 μm for that of FIG. 6B.

Thus it was confirmed that, though the energy input required for projecting fluid drops was somewhat greater than with a circular opening, the fluid drop projecting apparatus having a polygonal opening in which surface waves are generated at substantially equal distances from the fluid drop projecting point was also able to project fluid drops smaller than the opening bore by the interference of the surface waves. It was further confirmed that, like Embodiment 1, these embodiments of the invention, when applied to a recording head 52 as illustrated in FIG. 4, could form images on recording paper 51 by an ink jet recording process. However, since the fluid drop diameter in Embodiments 2 and 3 is 20 μm, greater than in Embodiment 1, images were recorded at a resolution of 1200 dpi in both main scanning and subscanning directions. It was confirmed that images of high quality could be formed thereby.

Embodiment 4

In Embodiment 4, the bore of the circular opening 13 is 1 mm, greater than in Embodiment 1. Except for the opening 13, this embodiment has the same configuration as Embodiment 1 illustrated in FIG. 1B. When the piezo actuator 12 was driven for t=200 μsec and its displacement d was gradually increased, steady projection of fluid drops became possible at d=4.8 μm, when the drop diameter was about 280 μm. It was confirmed that, even when the opening bore was a full millimeter, fluid drops 20 far smaller than the bore of the opening 13 could be projected.

Next, an experiment was carried out to determine the dependence of the diameter of projected fluid drops on the drive waveform of the piezo actuator 12. While the piezo actuator 12 was driven for t=200 μsec in the foregoing example in which fluid drops of 280 μm were projected, fluid drop projection was further attempted with different drive durations, varied to 145, 100 and 60 μsec. The displacement d of the piezo actuator 12 was also adjusted in accordance with the variation in drive duration so as to enable fluid drops 20 to be projected steadily. As a result, it was found that the fluid drop diameter could be reduced by shortening the drive duration. Thus, while the fluid drop diameter was about 250 μm at t=145 μsec and d=4.0 μm, it was about 200 μm at t=100 μsec and d=3.2 μm and about 140 μm at t=60 μsec and d=2.2 μm, the drops being steadily projected in all these cases (see Table 1).

TABLE 1

| Pulse width t | Displacement d | Fluid drop diameter |
|---|---|---|
| 200 μsec | 4.8 μm | 280 μm |
| 145 μsec | 4.0 μm | 250 μm |
| 100 μsec | 3.2 μm | 200 μm |
| 60 μsec | 2.2 μm | 140 μm |

Thus it was found that this fluid drop projecting apparatus according to the invention permits the diameter of fluid drops 20 to be varied by controlling the drive duration and displacement of the actuator 12. Varying the drive duration and displacement of the actuator corresponds to varying the speed of the fluid stream and the duration of fluid stream generation. Thus it was confirmed that the fluid drops can be controlled as desired by regulating the speed of the fluid stream and the duration of its generation.

Incidentally, although the speed of the fluid stream is controlled with the drive waveform of the actuator 12 in Embodiment 4, it was confirmed that, even when the actuator 12 was driven under the same conditions, the speed distribution of the fluid stream could be varied, and the diameter of flying fluid drops could be thereby regulated, by varying the diameter of the opening 13 and the shape, i.e. the diameter, depth or the like, of the bottom of the fluid drop projecting chamber 10.

Embodiment 5

Figure 7:
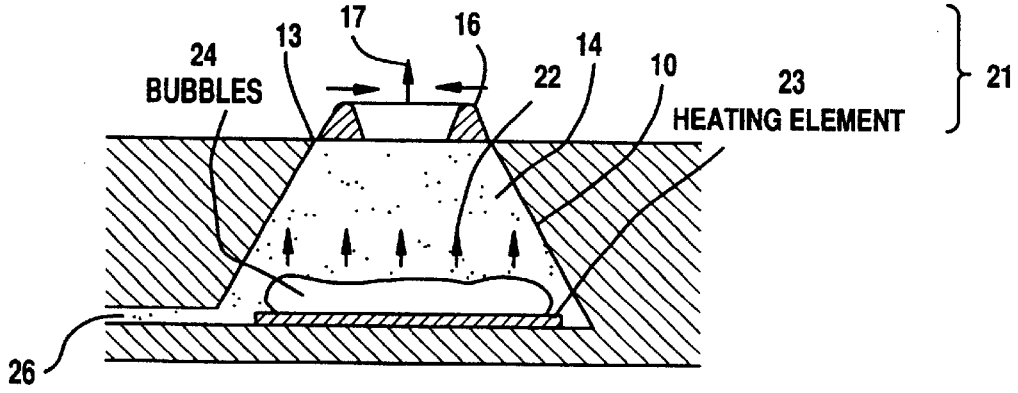
FIG. 7, illustrating a fifth embodiment (Embodiment 5) of the invention, shows a cross section of a fluid drop projecting apparatus using a surface wave generator comprising a heating element and a fluid drop projecting chamber.

While the foregoing Embodiments 1 through 4 use a fluid stream generator consisting of a diaphragm 11 and a piezo actuator 12, Embodiment 5 has, as shown in FIG. 7, a fluid stream generator consisting of a heating element 23 arranged on the bottom of the fluid drop projecting chamber 10. In other respects than the fluid stream generator, this embodiment has the same configuration as Embodiment 1 illustrated in FIG. 1A. In the fluid drop projecting apparatus shown in FIG. 7, rapid heating by the heating element 23 generates bubbles 24 in the fluid 14. A variation in pressure ensuing from the generation of these bubbles 24 gives rise to a fluid stream 22 toward the free surface 15 of the fluid 14 and, as in Embodiment 1, surface waves 16 travelling toward a fluid drop projecting point 17 are generated. The energy input to the heating element 12 was adjusted so that the action of the fluid stream 22 ensuing from the generation of the bubbles 24 would not let fluid drops 20 generate directly from the free surface 15 of the fluid 14.

As a result, when energy of 135 μJ was supplied to a circular heating element of 120 μm in diameter at a pulse width of 3 μsec, surface waves were formed successfully on the periphery of the opening 13 without letting fluid drops directly generate from the opening 13, enabling minute fluid drops 20 of about 25 μm in diameter to be projected. However, it was found that, with the apparatus of FIG. 7, increasing the energy input to the heating element even slightly would readily cause fluid drops 20 to be flown by the action of the fluid stream 22 and, accordingly, the conditions of energy input to the heating element 23 to ensure steady projection had only a narrow margin of allowance.

Embodiment 6

Figure 8:
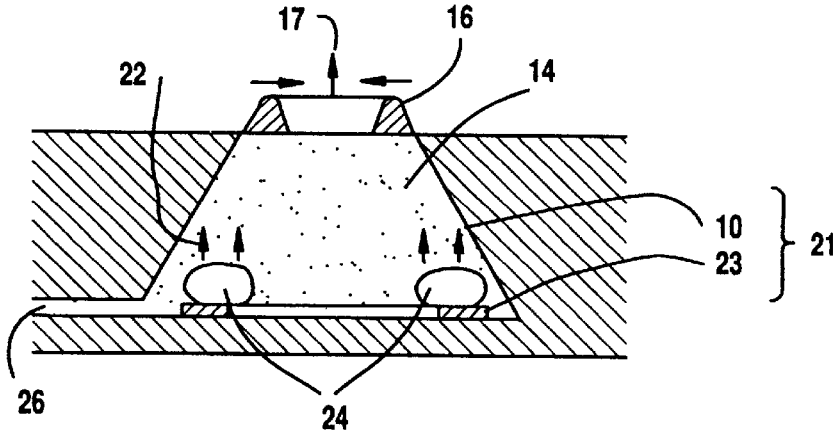
FIG. 8, illustrating a sixth embodiment (Embodiment 6) of the invention, shows a cross section of a fluid drop projecting apparatus in whose surface wave generator the heating element is arranged only on the bottom periphery of the fluid drop projecting chamber.

Then, a configuration in which the heating element was arranged only on the periphery of the bottom of the fluid drop projecting chamber 10, as illustrated in FIG. 8, was chosen for Embodiment 6. Namely, it is a doughnut-shaped heating element of 240 μm in outer and 200 μm in inner diameter. As a result, since a bubble 24 is generated in the peripheral part and no bubble is generated in the central part of the fluid drop projecting chamber 10 having the configuration shown in FIG. 8, it was found that ink drops could be prevented from being directly flown by the generation of bubbles, so that the margin of allowance for the conditions of energy input to project fluid drops 20 could be substantially widened. While Embodiment 5, in order to achieve steady projection of fluid drops, the total energy input to the heating element 23 had to be restrained within an approximate range of 135±7 μJ, Embodiment 6 was confirmed to permit steady projection within an energy input range of 70±20 μJ. It was further confirmed that, in the fluid drop projecting apparatus configured as shown in FIG. 8, the diameter of fluid drops 20 could be varied by regulating the energy input to the heating element 23. When the energy input to the heating element 23 was 42 μJ (at a pulse width of 3 μsec), fluid drops of 15 μm in diameter were found to be steadily projected. Next, when the energy input was varied to 70 μJ (at a pulse width of 5 μsec), fluid drops of 18 μm in diameter could be projected. Further at an energy input level of 98 μJ (at a pulse width of 7 μsec), fluid drops of 22 μm in diameter could be projected steadily.

It was further confirmed that the fluid drop projecting apparatuses which are Embodiments 5 and 6, like Embodiment 1, could be successfully applied to a recording head 52 having the configuration illustrated in FIGS. 4A–4B for ink jet image recording on recording paper 51.

Embodiment 7

Figure 9:
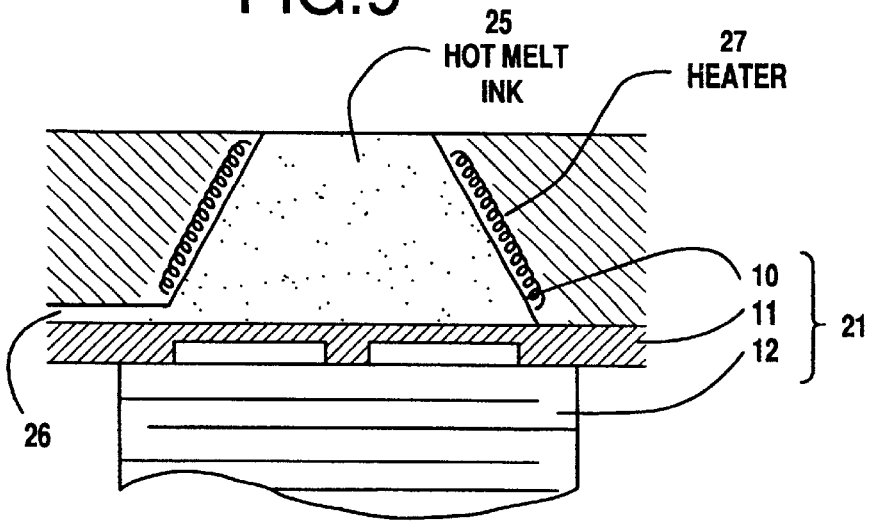
FIG. 9 shows a cross section of a seventh embodiment (Embodiment 7) of the invention using hot melt ink.

Next, Embodiment 7 uses as fluid hot melt ink 25 consisting of a blend of wax-based resin and carbon black. In this fluid drop projecting apparatus, a heater 27 was arranged along the inner wall of the fluid drop projecting chamber 10, in which ink was maintained in a molten state. A heater was also arranged in an ink tank (not shown) to keep the hot melt ink 25 molten. The fluid drop projecting chamber 10 is shaped similarly to what is shown in FIG. 1. Fluid drop projection was tested with the apparatus illustrated in FIG. 9 and, although the hot melt ink 25 required a greater energy input to the piezo actuator 12 for ink drop projection than water ink, making it necessary for the piezo actuator 12 to be driven for 5 μsec at a displacement of 0.42 μm, it was confirmed that ink drops of around 20 μm in diameter, far smaller than the opening 13, could be projected as with Embodiment 1. While this Embodiment uses hot melt ink consisting of a blend of wax-based resin and carbon black, other hot melt inks can give a similar result as well. It was further confirmed that this fluid drop projecting apparatus which is Embodiment 7, like Embodiment 1, could be successfully applied to a printer recording head 52 having the configuration illustrated in FIG. 4 for ink jet image recording on recording paper 51.

Embodiment 8

Figure 10:
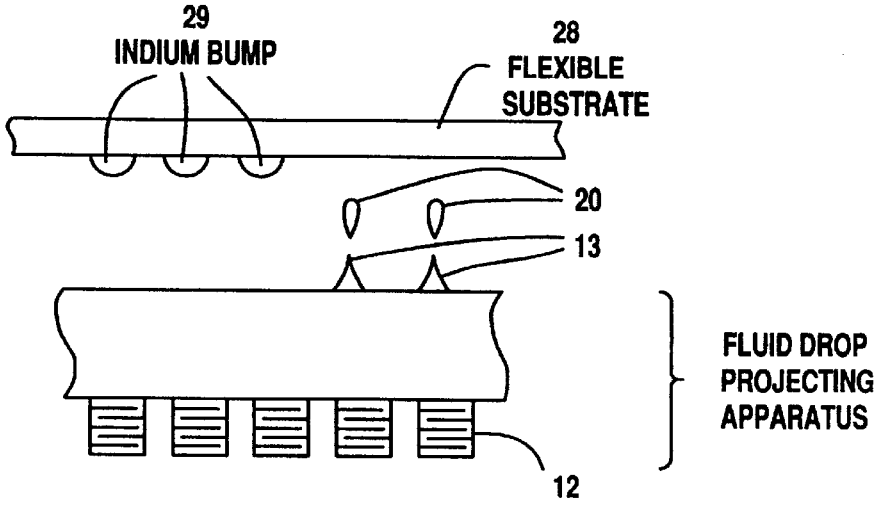
FIG. 10 shows a schematic profile of a bump forming device according to an eighth embodiment (Embodiment 8) of the invention.

Embodiment 8 is an instance in which fluid drop projecting apparatuses according to the present invention are applied to an apparatus for forming minute bumps for use in the connection of semiconductors or the like. The fluid drop projecting apparatuses used in this embodiment have the same configuration as Embodiment 7 shown in FIG. 9, i.e. the configuration in which the heater 25 is arranged along the inner wall of each fluid drop projecting chamber 10. Embodiment 8 will be described below with reference to FIG. 10. Indium, whose melting point is about 110° C., is used as electroconductive fluid, and an attempt was made to form indium bumps 29 of 50 μm in diameter in tip connecting parts formed at 80 μm pitches on a flexible substrate 28. The inside of the fluid drop projecting number 10 was heated with a heater to about 125° C. to give a displacement of 2.4 μm at a pulse width of 20 μsec to the actuator 12, and fluid drops were projected toward the flexible substrate 28, resulting in successful formation of indium bumps 29 of 50 μm in diameter in the connecting parts. When the flexible substrate 28 on which the indium bumps 29 had been formed were used for connecting a liquid crystal panel, the bumps functioned fully satisfactorily for the connecting purpose, demonstrating the possibility of highly reliable connection. Incidentally, although this particular embodiment of the invention uses indium as bump material, a low melting point metal such as solder, or some other bump material consisting of electroconductive particles of Au, Al, Cu or the like dispersed in a solvent, may be used as well.

Figure 11A:
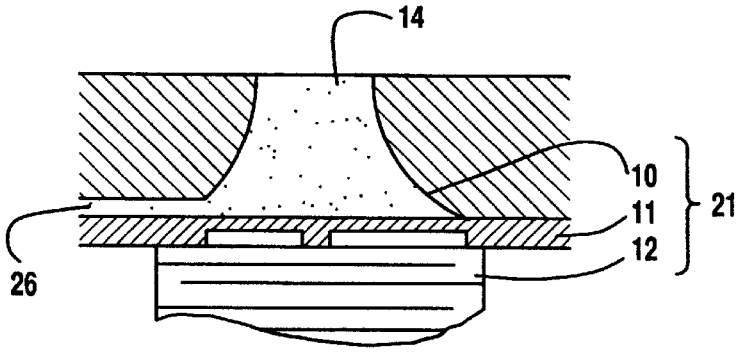
FIGS. 11A, 11B illustrate fluid drop projecting apparatuses according to the invention.
Figure 11B:
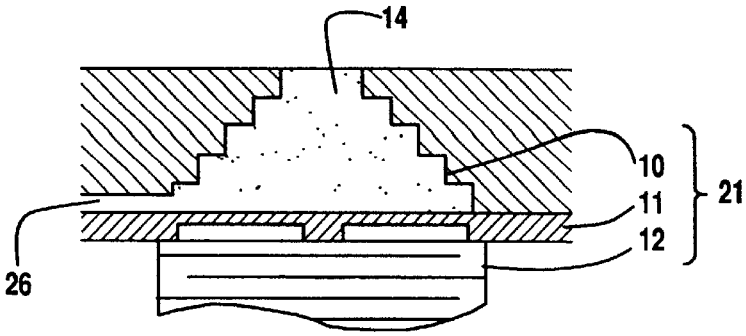
Figure 12A:
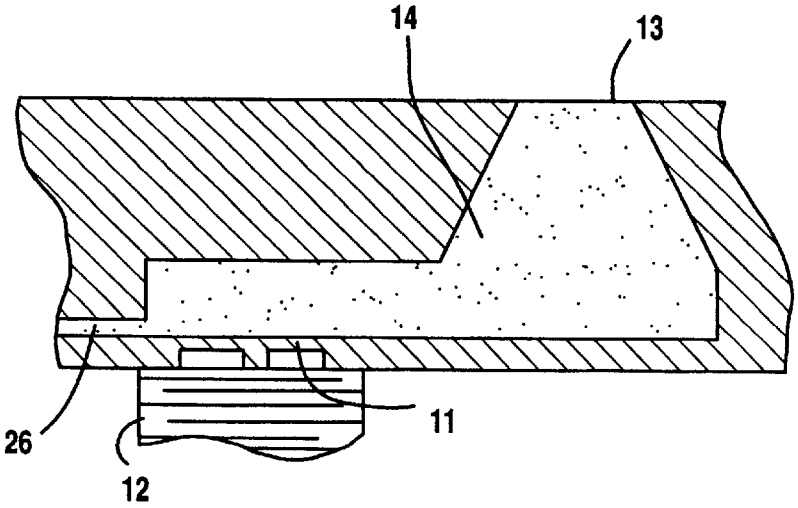
FIGS. 12A, 12B and 12C show a cross section of a fluid drop projecting apparatus according to the invention.
Figure 12B:
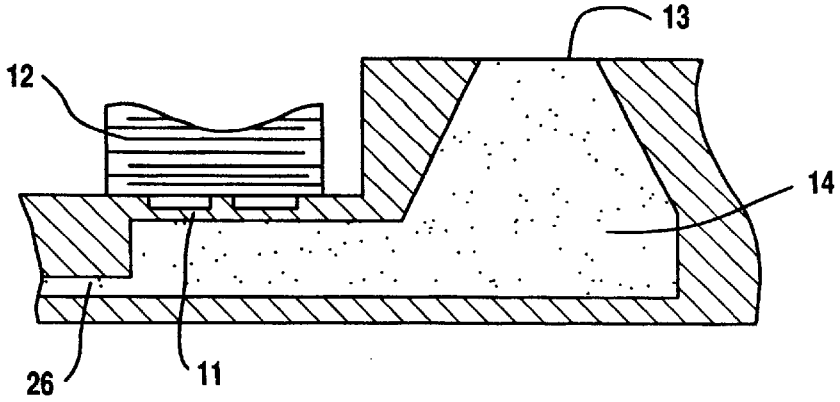
Figure 12C:
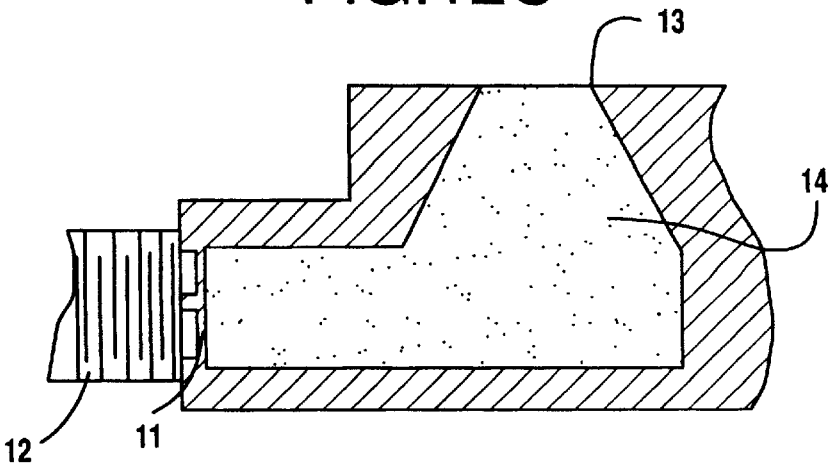
Figure 13A:
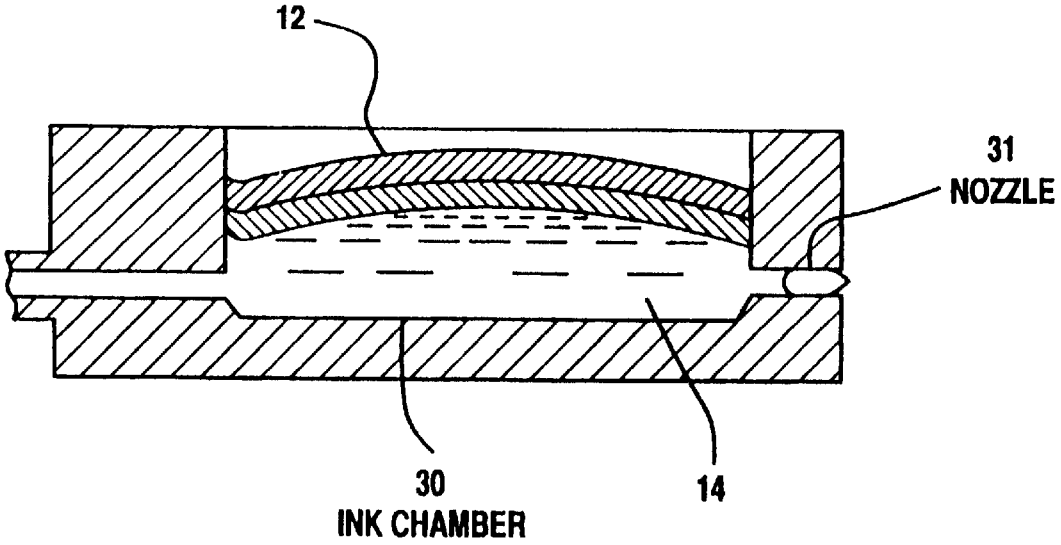
FIG.13A PRIOR ART
FIGS. 13A and 13B show a cross section of a fluid drop projecting apparatus according to the prior art utilizing the principle of pumping.
Figure 13B:
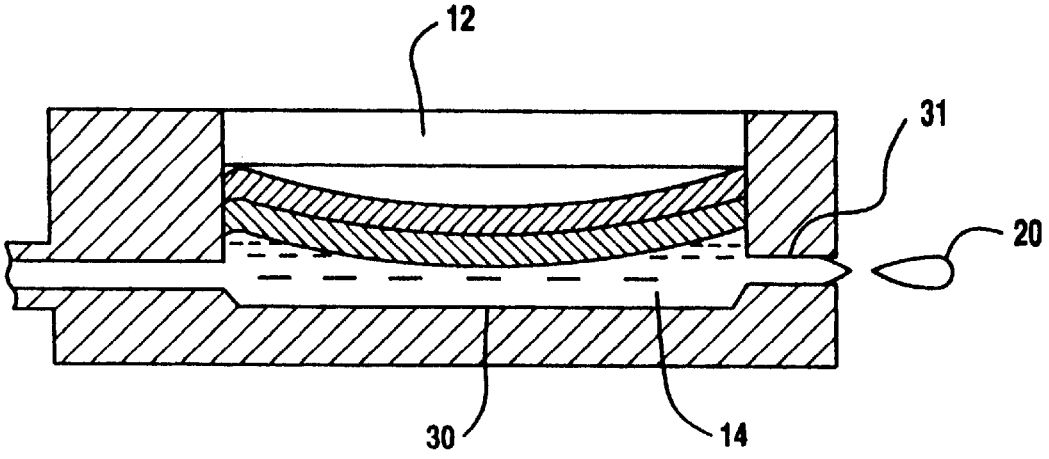
FIG.13B PRIOR ART
Figure 14A:
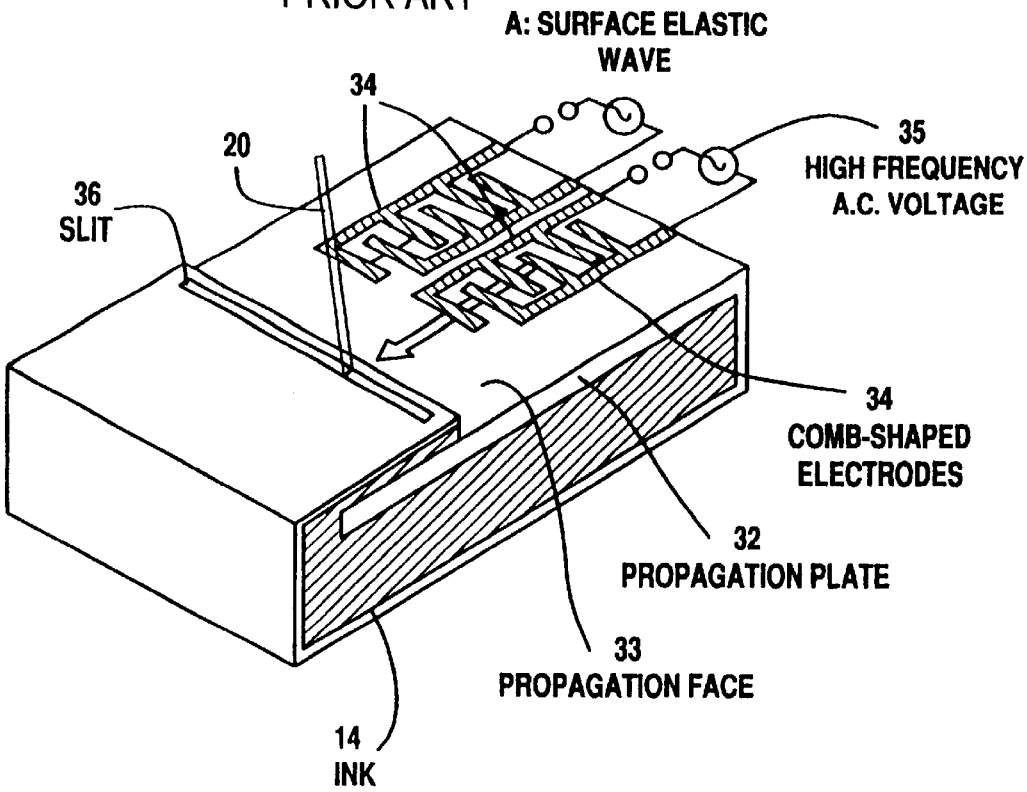
FIG.14A PRIOR ART
FIGS. 14A and 14B illustrate a fluid drop projecting apparatus according to the prior art utilizing the interference of the surface wave to project fluid drops in a mist form.
Figure 14B:
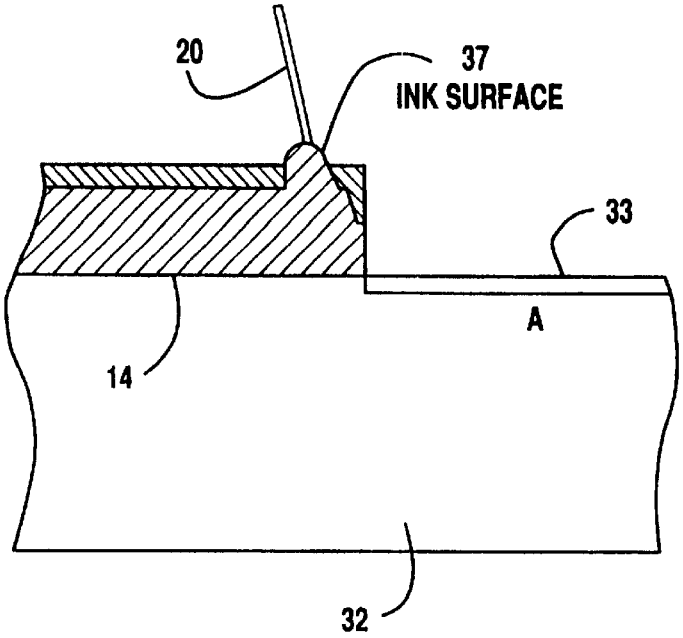
FIG.14B PRIOR ART
Figure 15:
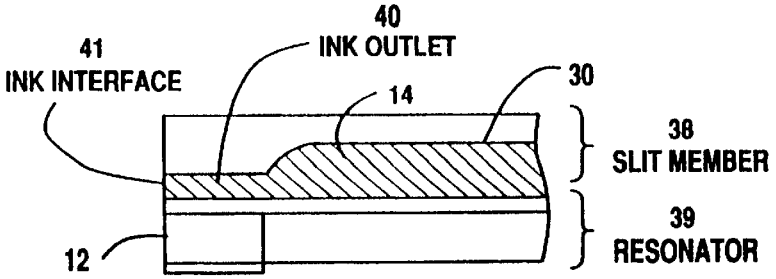
FIG.15 PRIOR ART
FIG. 15 shows a cross section of a fluid drop projecting apparatus according to the prior art utilizing the interference of surface waves to project fluid drops in a mist form.
Figure 16:
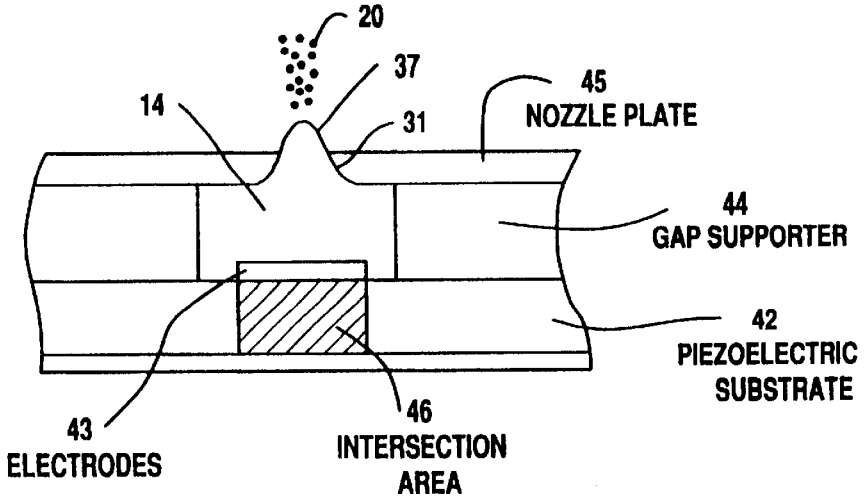
FIG.16 PRIOR ART
FIG. 16 shows a cross section of a fluid drop projecting apparatus according to the prior art utilizing the radiation pressure of a sound wave to project fluid drops in a mist form.
Figure 17:
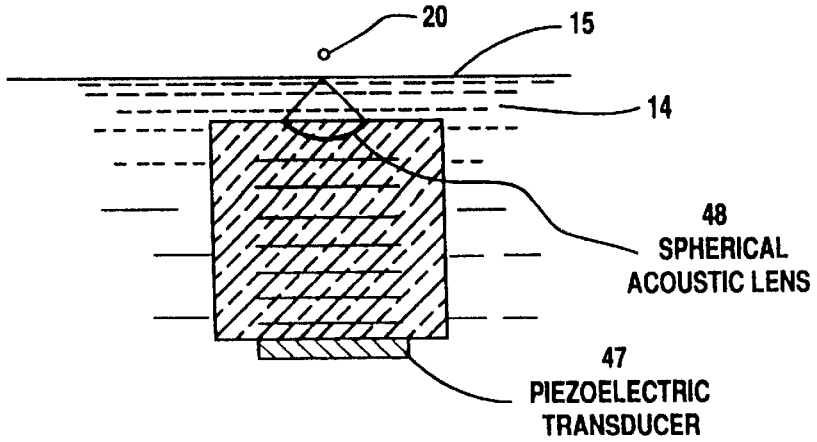
FIG.17 PRIOR ART
FIG. 17 shows a cross section of a fluid drop projecting apparatus according to the prior art utilizing the sound pressure of acoustic streaming

Thus, although a fluid drop projecting chamber whose opening bore linearly expands in the direction from the fluid surface to the bottom of the fluid drop projecting chamber is used in the above-described Embodiments 1 through 8, it was confirmed that, in order to permit the formation of surface waves travelling over the free surface of fluid toward the fluid drop projecting point, the opening may as well be bell mouth-shaped as illustrated in FIG. 11A or finely step-wise as in FIG. 11B, only if its bore gradually expands in the direction of depth, and the same effect could be achieved as the foregoing embodiments provide. Furthermore, though an actuator using the piezoelectric effect is used in Embodiments 1 through 4, 7 and 8 of the invention to displace the diaphragm, an electromagnetic or a magnetic actuator may be used as well if only it can give a desired displacement to the diaphragm. Although the displacement of the actuator is transmitted via the diaphragm in Embodiments 1 through 4, 7 and 8 of the invention, it was confirmed that the same effect could be achieved as the foregoing embodiments provide even if the diaphragm was dispensed with and a displacement was directly given to the fluid from an end of the actuator. Though the diaphragm is arranged immediately below the opening to compose a surface wave generator in the embodiments of the invention, any other structure in which a fluid stream would generate from the bottom of the fluid drop projecting chamber 10 toward the opening 13, as illustrated in FIG. 3A, would be acceptable; it was confirmed that a configuration in which the piezo actuator 12 and the relevant elements are arranged in a position somewhat distant from the bottom opposite to the opening 13, as shown in FIGS. 12A through 12C, could provide the same effect as the embodiments of the invention do.

Since a fluid drop projecting apparatus according to the present invention causes fluid drops to be projected by the interference of surface waves travelling toward the fluid drop projecting point, fluid drops far smaller than the opening bore can be flown one by one to the desired arrival point for each. The fluid drop projecting apparatus according to the invention can also permit the fluid drop diameter to be readily varied by controlling the length and height of the surface waves.

What is claimed is:

1. A fluid drop projecting head, comprising:

a surface wave generating means including a fluid drop projecting chamber containing a fluid, and having an opening at one end from which fluid drops are projected from a surface of fluid formed at said opening of the fluid drop projecting chamber, said surface wave generating means for forming a surface wave on the surface of fluid formed at said opening of the fluid drop projecting chamber, so that said surface wave is generated at a peripheral part of said opening of said fluid drop projecting chamber and made to travel toward a center of said opening corresponding to a fluid drop projecting point, and so that only said surface wave which is generated at the peripheral part of said opening causes a fluid drop to project from said surface of fluid formed at said opening of the fluid drop projecting chamber; and wherein said surface wave generating means further comprises a fluid stream generator which causes a part of said fluid which is near a bottom of said fluid drop projecting chamber to generate a stream flowing from said bottom of said fluid drop projecting chamber toward the surface of fluid; and wherein said fluid drop projecting chamber has an opening which gradually expands in the direction away from said opening toward said bottom of said fluid drop projecting chamber.

2. The fluid drop projecting head according to claim 1, wherein said fluid stream generator generates an intermittent fluid stream from said bottom of said fluid drop projecting chamber to the surface of the fluid at said opening of said fluid drop projecting chamber.

3. The fluid drop projecting head, as claimed in claim 2, wherein said fluid stream generator includes a diaphragm which is connected to said bottom of said fluid drop projecting chamber, and which is operable to be displaced in a direction from the bottom of said fluid drop projecting chamber toward the surface of fluid; and an actuator connected to said diaphragm for displacing said diaphragm intermittently.

4. The fluid drop projecting head, as claimed in claim 2, wherein said fluid is a hot melt medium that is solid at normal temperature and melted by heating, and said fluid drop projecting chamber further comprising a heating element that is arranged along an inside wall of said opening gradually expanding in the direction away from said opening toward a bottom of said fluid drop projecting chamber.

5. A fluid drop projecting head, as claimed in claim 4, wherein said hot melt medium is electroconductive.

6. The fluid drop projecting head, as claimed in claim 2, wherein said fluid stream generator includes a heating element arranged near said bottom of said fluid drop projecting chamber to heat said fluid in said fluid drop projecting chamber intermittently.

7. A method of projecting a fluid drop from a fluid drop projecting head, comprising the steps of:

providing a surface wave generator including a fluid drop projecting chamber containing a fluid and having an opening at one end from which fluid drops are projected from a of fluid formed at the opening of the fluid drop projecting chamber, said fluid drop projecting chamber having an opening which gradually expands in the direction away from said opening toward a bottom of said fluid drop projecting chamber; and operating said surface wave generator so as to generate a surface wave on the surface of fluid formed at a peripheral part of the opening of the fluid drop projecting chamber causing the surface wave to travel toward a center of the opening corresponding to a fluid drop projecting point, and so that only the surface wave which is generated at a peripheral part of the opening causes a fluid drop to project from the surface of fluid formed at said opening of the fluid drop projecting chamber.

8. The method of projecting a fluid drop from a fluid drop projecting head in accordance with claim 7, wherein said step of operating said surface wave generator includes causing a part of said fluid which is near said bottom of said fluid drop projecting chamber to generate a stream flowing from said bottom of said fluid drop projecting chamber toward the surface of fluid.

9. A fluid drop projecting head comprising:

a fluid drop projecting chamber containing a hot melt medium that is solid at normal temperature and melted by heating, and comprising:

an opening at one end from which drops of said hot melt medium are projected from a surface of said hot melt medium formed at said opening, said chamber gradually expanding in a direction away from said opening toward a bottom of said fluid drop projecting chamber;

a heating element, which is arranged along an inside wall of said chamber gradually expanding in the direction away from said opening toward a bottom of said fluid drop projecting chamber;

a surface wave generating means attached to the bottom of said fluid drop projecting chamber for rising an intermittent fluid stream of said hot melt medium from the bottom of the fluid drop projecting chamber toward the surface of fluid of said hot melt medium to generate a surface wave on the surface of fluid at said opening of the fluid projecting chamber that travels from a peripheral part of said opening toward a center of said opening corresponding to a fluid drop projecting point and is projected as a drop of said hot melt medium; and a surface wave controller for controlling a moving velocity and rising intervals of said fluid stream risen by said surface wave generating means.

10. The fluid drop projecting head, as claimed in claim 9, wherein said surface wave generating means further comprises:

a diaphragm, which is connected to the bottom of said fluid drop projecting chamber, for rising said fluid stream by movements in a direction from the bottom of said fluid drop projecting chamber toward the surface of fluid;

an actuator connected to said diaphragm for moving said diaphragm; and wherein, said surface wave controller controls actuating conditions of said actuator.

11. A fluid drop projecting head, as claimed in claim 10, wherein said hot melt medium is electroconductive.

12. A fluid drop projecting head, as claimed in claim 9, wherein said hot melt medium is electroconductive.

13. A method of projecting a fluid drop from a fluid drop projecting head having a fluid drop projecting chamber containing a fluid, and the fluid drop projecting chamber having an opening at one end, the fluid drop projecting chamber gradually expanding from the opening in a direction away from the opening toward a bottom of the fluid drop projecting chamber, the fluid drop projecting chamber also having a diaphragm connected to the bottom of the fluid drop projecting chamber and an actuator connected to the diaphragm, said method comprising the steps of:

controlling actuating conditions of the actuator;

moving the diaphragm by the actuator in a direction from the bottom of the fluid drop projecting chamber toward a surface of fluid at the opening of the fluid drop projecting chamber; and rising an intermittent fluid stream, by movement of the diaphragm, from the bottom of the fluid drop projecting chamber toward the surface of fluid to generate a surface wave on the surface of fluid at the opening of the fluid drop projecting chamber that travels from a peripheral part of the opening toward a center of the opening corresponding to a fluid drop projecting point and that is then projected as a fluid drop.

14. A method of projecting a fluid drop from a fluid drop projecting head having a fluid drop projecting chamber containing a fluid, and the fluid drop projecting chamber having an opening at one end and gradually expanding from the opening in a direction away from the opening toward a bottom of the fluid drop projecting chamber, the fluid drop projecting head also having a heating element arranged near the bottom of the fluid drop projecting chamber, the method comprising the steps of:

controlling heating conditions of the heating element; and rising an intermittent fluid stream, by heat of the heating element, from the bottom of the fluid drop projecting chamber toward the surface of fluid to generate a surface wave on the surface of fluid at the opening of the fluid drop projecting chamber that travels from a peripheral part of the opening toward a center of the opening corresponding to a fluid drop projecting point and that is then projected as a fluid drop.

15. A method of projecting a fluid drop from a fluid drop projecting head having a fluid drop projecting chamber containing a hot melt medium, which is solid at normal temperature and melted to a fluid by heating, the fluid drop projecting chamber having an opening at one end and gradually expanding in a direction away from the opening toward a bottom of the fluid drop projecting chamber, and also having a heating element arranged along an inside wall of the fluid drop projecting chamber gradually expanding in the direction away from said opening toward a bottom of said fluid drop projecting chamber, said method comprising the steps of:

heating the heating element for melting the hot melt medium;

generating a surface wave on the surface of fluid of the hot melt medium at the opening of the fluid drop projecting chamber that travels from a peripheral part of said opening toward a center of said opening corresponding to a fluid drop projecting point and that is then projected as a fluid drop; and controlling a wave length and a wave height of the surface wave generated on the surface of fluid of the hot melt medium formed at the opening of the fluid drop projecting chamber.

16. A method of projecting a fluid drop from a fluid drop projecting head having a fluid drop projecting chamber containing a hot melt medium, which is solid at normal temperature and melted to a fluid by heating, the fluid drop projecting chamber having an opening at one end and gradually expanding in a direction away from said opening toward a bottom of the fluid drop projecting chamber, the fluid drop projecting chamber also having a diaphragm connected to the bottom of the fluid drop projecting chamber, an actuator connected to the diaphragm and a heating element arranged along an inside wall of the fluid drop projecting chamber gradually expanding in the direction away from the opening toward a bottom of said fluid drop projecting chamber, the method comprising the steps of:

heating the heating element for melting the hot melt medium;

controlling actuating conditions of the actuator;

moving the diaphragm by the actuator in a direction from the bottom of the fluid drop projecting chamber toward the surface of fluid; and rising an intermittent fluid stream, by movement of the diaphragm, from the bottom of the fluid drop projecting chamber toward the surface of fluid of the hot melt medium to generate a surface wave on the surface of fluid of the hot melt medium at the opening of the fluid drop projecting chamber that travels from a peripheral part of the opening toward a center of the opening corresponding to a fluid drop projecting point and that is then projected as a fluid drop.

* * * * *